US006312231B1

(12) United States Patent
Kuhne et al.

(10) Patent No.: US 6,312,231 B1
(45) Date of Patent: Nov. 6, 2001

(54) AXIAL PISTON PUMP WITH OBLIQUE DISK

(75) Inventors: Manfred Kuhne, Meerbusch (DE); Jimmy Johansson, Schweden (SE); Bruce D. Larkin, Plainwell, MI (US)

(73) Assignee: Parker Hannifin GmbH, Kaarst (DE)

( * ) Notice: Subject to any disclaimer, the term of this patent is extended or adjusted under 35 U.S.C. 154(b) by 0 days.

(21) Appl. No.: 09/506,058

(22) Filed: Feb. 17, 2000

(30) Foreign Application Priority Data

Feb. 17, 1999 (DE) ..... 199 06 540

(51) Int. Cl.[7] ..... F04B 1/26

(52) U.S. Cl. ..... 417/222.1; 417/269; 91/504; 91/499; 92/12.2

(58) Field of Search ..... 417/222.1, 269; 91/504, 505, 499; 92/12.2

(56) References Cited

U.S. PATENT DOCUMENTS

| | | | | |
|---|---|---|---|---|
| 2,737,895 | * | 3/1956 | Ferris | 417/269 |
| 5,450,823 | * | 9/1995 | Istomin | 123/56.3 |
| 5,515,768 | * | 5/1996 | Fritz et al. | 92/71 |
| 5,588,347 | * | 12/1996 | Jepsen | 92/12.2 |
| 6,068,451 | * | 5/2000 | Uppal | 417/222.1 |

FOREIGN PATENT DOCUMENTS

| | | | | |
|---|---|---|---|---|
| GM 72 2 129 U | | 4/1987 | (DE) . | |
| 450623-A1 | * | 10/1991 | (EP) | 417/222.1 |

OTHER PUBLICATIONS

Delivery Catalaog 2500 D of Parker Hannifin GmbH, Hydraulic Controls Division, 41565 Kaarst, 3rd Edition (1997), pp. 1–64.

* cited by examiner

*Primary Examiner*—Cheryl J. Tyler
(74) *Attorney, Agent, or Firm*—Christopher H. Hunter

(57) ABSTRACT

In an axial piston pump having an oblique disk, the axial piston pump includes a piston drum with pistons disposed therein that are displaceable by way of a holder that runs along the oblique disk. The angle of engagement of the oblique disk can be increased. On the outer side of a spherical adjustment surface provided on a component of a shaft, there are at least two glide blocks that are rotatable about a rotational mount and that exhibit an axial extent with respect to the drive shaft axis. For the purpose of transmitting torque from the drive shaft to a holder, the glide blocks are engaged with grooves that are provided in the holder, and in particular in the wall of the holder that circumscribes a receiving bore of the holder.

11 Claims, 2 Drawing Sheets

AXIAL PISTON PUMP WITH OBLIQUE DISK

RELATED APPLICATIONS

The present application claims priority to German Patent Application No. DE 199 06 540.3 filed Feb. 17, 1999, the disclosure of which is incorporated herein by reference.

BACKGROUND OF THE INVENTION

The invention relates to axial piston pumps having oblique disks. One known type of axial piston pump has a piston drum that is rotatably displaceable by way of a rotatable drive shaft and that has a number of bore holes disposed therein.

Pistons are disposed in the piston bore holes and are displaceable between a lower dead-center point and an upper dead-center point. The pistons are each driven by an articulated piston rod that is reciprocably displaceable by way of an oblique disk. The disk is adjustable in its inclination with respect to the piston drum. A holder is provided to guide the piston rods. The holder is always oriented in parallel with respect to the oblique disk. The drive shaft is supported by way of a ball-type formation in a central receiving bore of the holder.

An axial piston pump with the aforementioned features is known from Delivery Catalog 2500 D of Parker Hannifin GmbH, Hydraulic Controls Division, 41564 Kaarst, 3rd edition (1997), page 1–64. The drive shaft, which rotationally displaces the piston drum via a toothed engagement, and which itself is driven, is supported by way of its forward, ball-type end on the central receiving bore of a holder. The holder is adjustable by way of the oblique disk and, in that connection, is always oriented in parallel to the oblique disk. The piston rods that connect to the pistons extend through the holder in corresponding bore holes. The end of each piston is coupled to a travel shoe that, during rotation of the piston drum relative to the fixed oblique disk, will run along the oblique disk so that the piston rods are displaced reciprocally, and thereby drive the pistons. The holder holds the travel shoes (that run along the oblique disk when the piston drum rotates) in place on the oblique disk with a predetermined bias and rotates synchronously with the piston drum.

In known axial piston pumps, as long as the driving of the piston drum takes place by way of the drive shaft coupled with it in form-fit fashion, a torque will be transferred from the piston drum through the pistons that reciprocate in the piston bore holes and the piston rods that extend through the holder. One disadvantage of this structure is that, for pistons resting in the lower dead-center point in the piston bore hole, a minimal axial covering of the piston must be provided by the wall of the piston bore hole in order to guarantee an adequate transfer of torque between the piston drum and the piston. When the piston is in that position, the angle of engagement of the oblique disk is limited, which limits the output of the axial piston pump.

With oblique disk pumps known in the art, the maximum angle of engagement, as a rule, is about 18 degrees. If the output of the pump is increased by way of a greater angle of engagement of the oblique disk, this will necessarily lead to the structural size of the piston drum being increased in the axial direction since, in addition to the longer piston travel achieved with a greater angle of engagement, one will need to account for the necessary minimal covering of the piston with the piston bore hole. With a zero-degree angle of engagement of the oblique disk with respect to the drive shaft, the extension of the piston rods through the holder must correspond exactly to the piston bore holes in the piston drum because of the task of transmitting torque to the holder that is accorded the pistons. An increase in the angle of engagement will lead to an undesirable increase in the structural size of the pump in the radial direction, since otherwise the travel shoes would displace too closely to the drive shaft.

The object of the invention is thus to improve upon an axial piston pump, that has the features mentioned above, in such a way that the angle of engagement of the oblique disk can be made greater without changing the structural size of the pump.

The solution to this objective encompasses advantageous developments and modifications associated with the invention in accordance with the content of the claims appended to this specification.

SUMMARY OF THE INVENTION

The invention provides that, in order to support the drive shaft on the holder, a ball head is provided that is connected to the drive shaft. The ball head has a sphere-shaped adjustment surface inserted in the receiving bore of the holder. Further, on the outer side of the spherical adjustment surface there are at least two glide blocks that are rotatable about a rotational mount and that exhibit an axial extent with respect to the drive shaft axis. For the purpose of transmitting torque from the drive shaft to the holder, the glide blocks are engaged with grooves in the holder. The grooves are preferably provided in the wall of the holder that circumscribes the receiving bore.

The basic concept of the invention resides in transmitting the torque needed for rotationally driving the holder directly from the drive shaft to the holder, yet the holder is positionally adjustable with respect to the drive shaft. With the arrangement according to the invention, the form-fit engagement between the adjustment surface (fixed with respect to the shaft) and the holder is retained, which serves to transmit torque. The holder can advantageously be altered in terms of its angle of engagement with respect to the shaft axis without regard for the axial length of the piston drum. The glide blocks, that are engaged in the grooves of the holder and are mounted on the spherical adjustment surface of the ball head that is connected with the drive shaft, will follow along with relative changes in position because of their rotatable formation. In each angular position of the holder with respect to the drive shaft, the guide blocks will remain in engagement with the corresponding grooves of the holder.

In this connection, the radial depth of a corresponding groove is dimensioned so that, for each maximal angle of engagement of the holder with respect to the drive shaft axis, the glide block can assume a skewed position in the groove that depends on the positioning of the glide block on the spherical adjustment surface and on its structural height.

Pursuant to a specific aspect of the invention, the piston rods are held in the holder, at their free ends, by way of an articulated connection. The holder, when it rotates, runs freely along the oblique disk. On its running surface, the holder has recesses oriented towards the oblique disk. These recesses are connected with the work chamber of the piston bore hole via bores that are formed in the holder and in the piston rods connected therewith. The travel shoes used in the prior art are not necessary. Since the recesses in the running surface of the holder are filled with oil on account of their connection with the work chamber of the corresponding piston bore, the holder will run along the oblique disk on a film of oil. This reduces friction and curtails corrosion of the components. Since the piston rods no longer extend through the holder, but are actually held in it, the mechanics of aligning the holder and piston drum to one another are simplified.

According to one embodiment of the invention, several glide blocks are distributed about the circumference of the spherical adjustment surface in symmetrical fashion and are arranged in grooves associated with the holder.

Since the overall construction of the piston drum with the pistons and the holder connected therewith can, at any given time, only be realized in one position of the holder and piston drum with respect to one another in order to establish the needed synchronization of the rotational movement of the piston drum and the holder, the piston drum and holder are designed for mutual and matching alignment with respect to the drive shaft during mounting. As far as one embodiment according to the invention contemplates that the ball head supported on the holder be slidably arranged on the drive shaft, the ball head can be prestressed by way of a compression spring positioned on the holder. The compression spring is preferably supported on the piston drum and acts on the ball head by way of pressure rods. A fitting spring arrangement is provided between the drive shaft and piston drum as well as between the drive shaft and ball head for aligning the holder and piston drum. The fitting spring arrangement includes a fitting spring that lies in a fitting spring groove provided in each of the components to be connected. The fitting spring grooves are arranged in the direction of the drive shaft axis in alignment with one another.

Aligning the piston drum and the holder with one another can also be accomplished in that, for mutual and matching alignment of the piston drum and the holder during mounting, the toothing that establishes the connection between the drive shaft and the piston drum includes a tooth of greater height. Such a tooth brings about a defined position of the piston drum on the drive shaft. A singular association of the piston drum with the drive shaft results, and by way of the glide block/groove connection of the drive shaft with the holder, a singular alignment of the holder with respect to the piston drum is brought about.

Further features and advantages of the present invention will become apparent to those skilled in the art upon reviewing the following specification and attached drawings.

DETAILED DESCRIPTION OF THE PREFERRED EMBODIMENT

Figure 1:
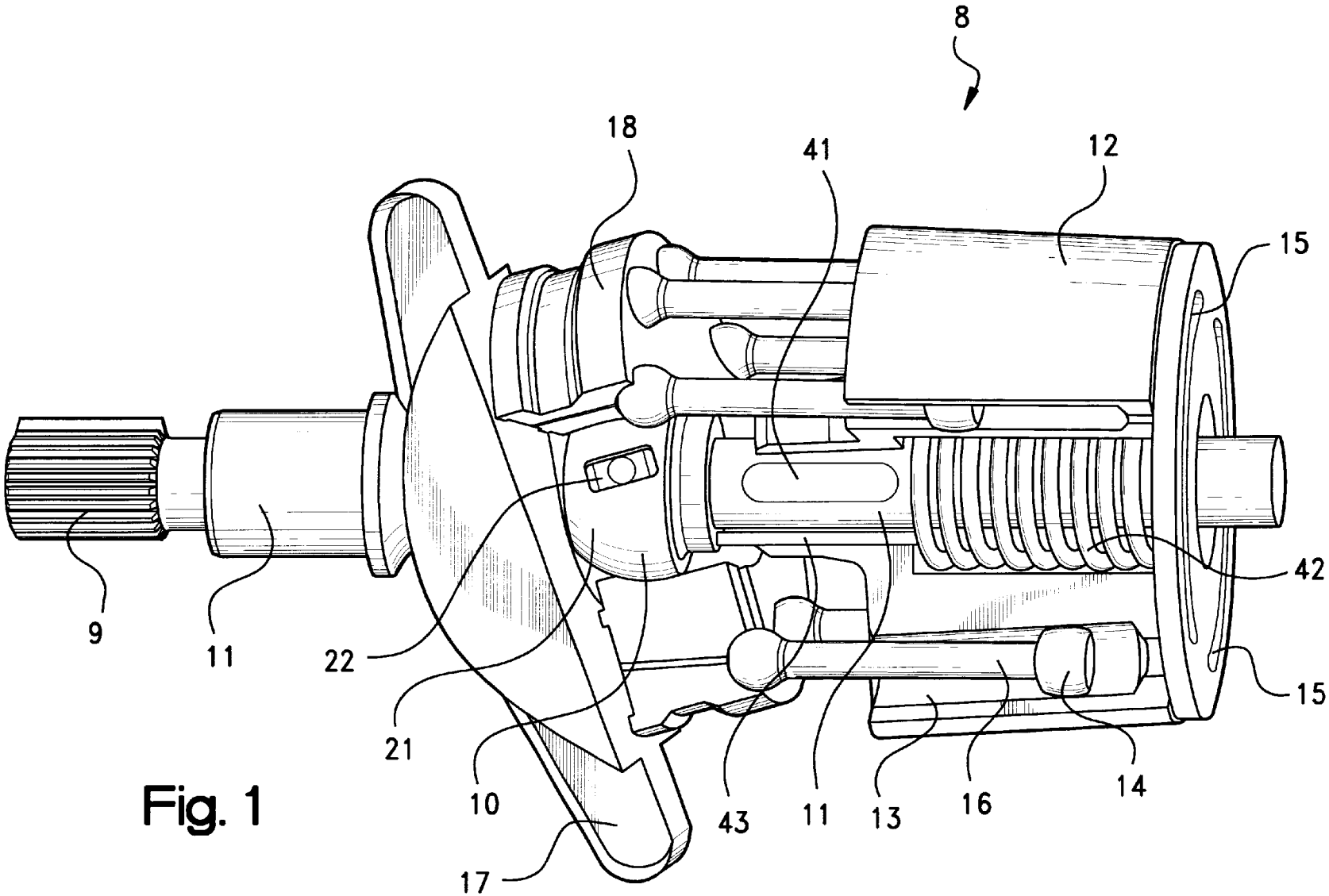
FIG. 1 shows, in a side cross-sectional view, an axial piston pump constructed according to the principles of the present invention.

Referring to the drawings, an axial piston pump constructed according to the principles of the present invention is indicated generally at 8. The piston pump includes a housing (not shown in any detail) of an axial piston pump having an oblique disk, a drive shaft 11, that is coupled with a drive (not shown) by way of a toothing 9, is rotatably mounted. A piston drum 12 is arranged on the drive shaft, by way of a form-fit engagement established via a fitting spring connection, in such a way that the shaft 11 displaces the piston drum 12 rotationally.

In the piston drum 12, a number of piston bore holes 13 are distributed about the circumference of the drum. In each bore hole, a piston 14 is slidable between a lower dead-center point and an upper dead-center point. A kidney-shaped connector 15 connects into the work chamber of the piston bore hole 13. In known manner, the connector 15 has a low-pressure side and a high-pressure side. Through rotation of the piston drum 12, kidney connector 15 is brought into communication with each respective piston bore hole 13.

In the vicinity of the lower dead-center point of piston 14 in the bore hole 13, the piston is connected to a holder 18 by way of a piston rod 16. Holder 18 runs freely upon an oblique disk 17 when the piston drum 12 rotates. Oblique disk 17 is adjustable in terms of its inclination with respect to the axis of drive shaft 11. The holder 18, which is provided between oblique disk 17 and piston drum 12, is driven in such a way (to be described below) that it rotates synchronously with the piston drum 12. The holder 18 has a central receiving bore 20 in which a ball head 10 is received. Ball head 10 sits on drive shaft 11 and is rotationally fixed thereon, and has a spherical adjustment surface 21. The ball head is engaged so that the angular position of holder 18 with respect to the longitudinal axis of the drive shaft 11 can be changed. The holder 18 further includes cups 29 that are associated with the pistons 14 of piston drum 12 as well as piston rods 16, whereby the ball-shaped end of a piston rod 16 is held in a cup in articulated fashion.

Figure 3:
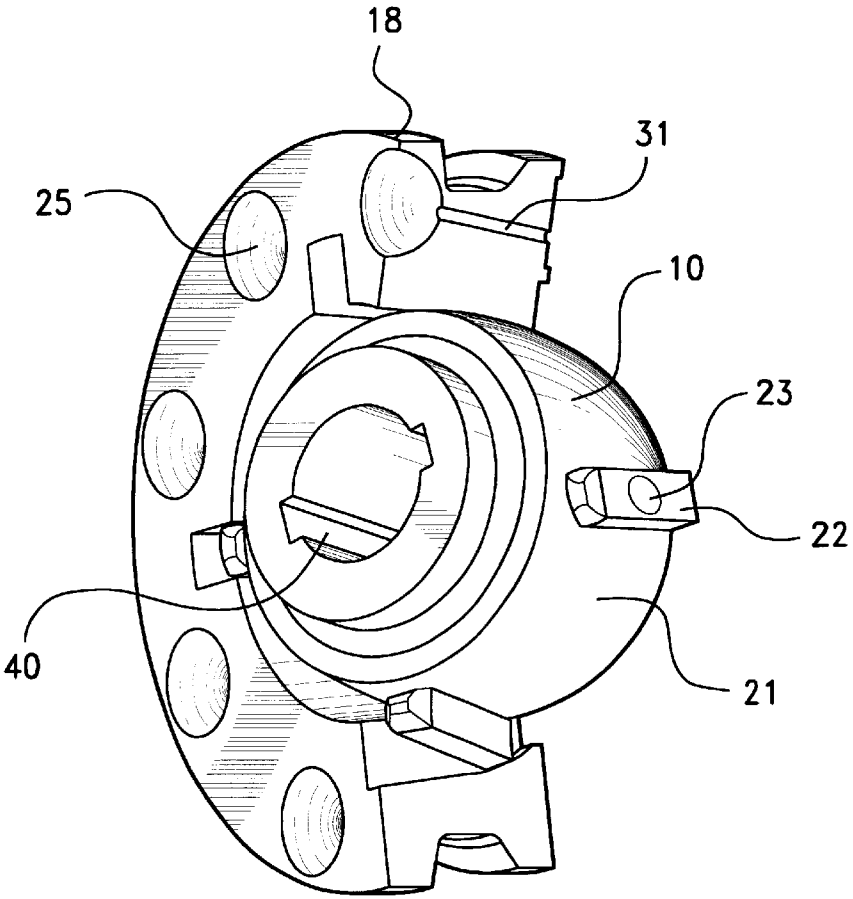
FIG. 3 shows the holder in a rear view on the piston side.
Figure 2:
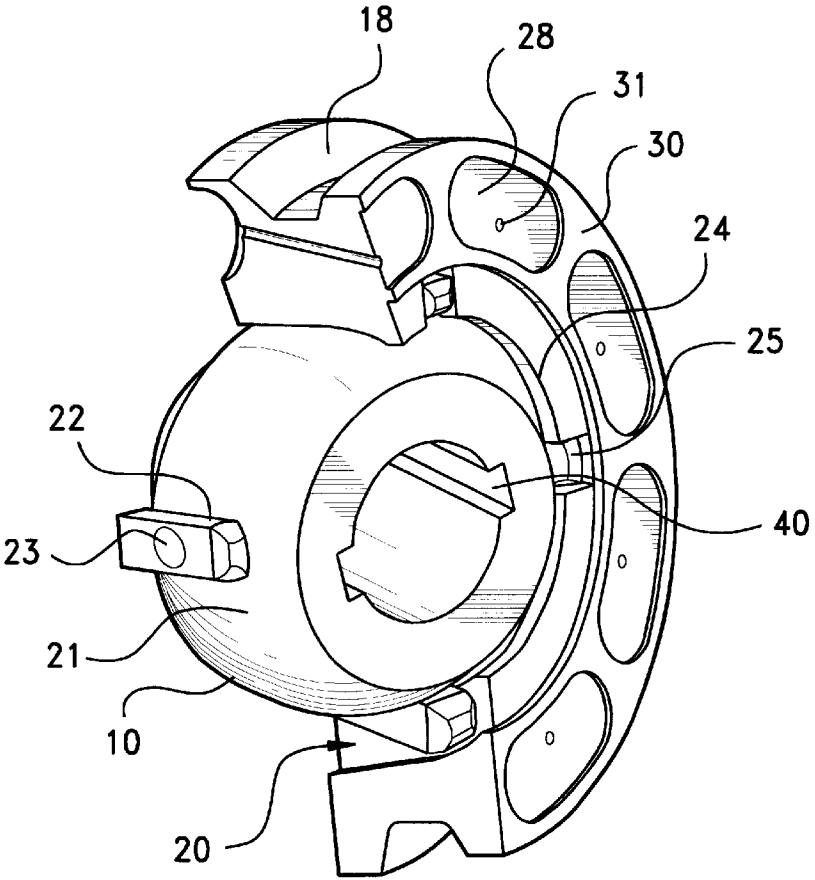
FIG. 2 shows the combination of a holder and a drive shaft for the axial piston pump in an enlarged, individualized view, particularly, in a rear view of the running surface of the holder.

In accordance with the invention, to the extent that the drive torque for rotating the holder 18 is directly transferred from drive shaft 11 to the holder 18 by way of the piston drum 12, the illustrated embodiment includes four glide blocks 22 that are distributed in symmetrical fashion about the circumference of the spherical adjustment surface 21 of ball head 10. Each glide block is rotatable about a rotational mount 23, and has a predetermined axial extent. The glide blocks 22 are in engagement with grooves 25 that are provided in the wall 24 that circumscribes the receiving bore 20, whereby the width of the grooves 25 corresponds to the structural width of the glide blocks 22. The radial depth of a groove 25 is dimensioned in such a way that for the maximal angle of engagement of the holder 18 with respect to the axis of drive shaft 11 in each case, the corresponding glide block 22 can assume the skewed position imposed, depending on its positioning on the spherical adjustment surface 21. This arrangement can be appreciated from FIGS. 2 and 3.

With this configuration, the torque for driving the holder 18 will be transferred directly from the drive shaft 11 to the holder 18 so that some covering between piston 14 and bore hole 13, that takes place in all angular positions throughout the range of adjustment of oblique disk 17 with respect to piston drum 12, can be provided without regard for loading forces.

In connection with relinquishing the travel shoes used in the prior art to permit the holder 18 to run freely along the oblique disk 17, there are recesses 28 provided in the running surface 30 that runs along oblique disk 17. The recesses are connected with the work chamber of piston 14 by way of bores 31 that are formed in the holder 18 itself as well as in the connecting piston rods 16, so that oil can enter each recess 28 through the bores 31. In this way, holder 18 runs on a film of oil over oblique disk 17.

Since, in the illustrated embodiment, the drive shaft 11 extends through holder 18 as well as oblique disk 17, the ball head 10 must be slidably disposed on drive shaft 11 in order to create a spring prestress with regard to the position of holder 18 on oblique disk 17. In order to generate the compression needed, a compression spring 42 acts on ball head 10 by way of pressure rod 43. The compression spring is supported in the piston drum and holds the ball head in engagement with the holder 18 and, in this connection, holds holder 18 in engagement on the oblique disk 17. To the extent that, in that connection, there also needs to be a synchronization of the rotational movement of each component that is connected with drive shaft 11, fitting spring connections are provided between the ball head 10 and the drive shaft 11, and also between the drive shaft 11 and the piston drum 12. With the fitting spring connections, a fitting spring groove 40 is provided in each corresponding component, and a fitting spring 41 is disposed therein to form a mutual connection.

As such, the present invention thereby provides and improved axial piston pump with a holder that can be adjusted over a wider range to increase the outlet of the pump, without the needs for increasing the axial length of the piston pump.

The principles, preferred embodiments and modes of operation of the present invention have been described in the foregoing specification. The invention which is intended to be protected herein should not, however, be construed as limited to the particular form described as it is to be regarded as illustrative rather than restrictive. Variations and changes may be made by those skilled in the art without departing from the scope and spirit of the invention as set forth in the appended claims.

What is claimed is:

1. An axial piston pump, comprising:

a piston drum that is rotatably displaceable by way of a rotatable drive shaft and including a number of bore holes disposed therein, a plurality of pistons disposed in the bore holes and displaceable between a lower dead-center point and an upper dead-center point, said pistons being driven by an articulated piston rod that is reciprocably displaceable by way of an oblique disk, said oblique disk being adjustable in its inclination with respect to the piston drum, a holder in parallel with respect to the oblique disk to guide the piston rods, the drive shaft supported on the holder by way of a ball head on the drive shaft received in a central receiving bore of the holder, the ball head having a spherical adjustment surface with at least two glide blocks on an outer side of the spherical adjustment surface, the glide blocks rotatable about a rotational mount and having an axial extent with respect to the drive shaft axis, the glide blocks engaged with grooves in a wall of the holder circumscribing the receiving bore of the ball head for transmitting torque from the drive shaft to the holder.

2. The axial piston pump as in claim 1, wherein a free end of each of the piston rods is held in the holder by way of an articulated connection, while the holder, when it rotates, runs freely along the oblique disk, the holder having recesses in the running surface oriented towards the oblique disk, the recesses being connected with a work chamber of the piston bore hole via bores that are formed in the holder and in the piston rods connected therewith.

3. The axial piston pump as in claim 2, wherein several glide blocks are distributed about the circumference of the spherical adjustment surface of the ball head in symmetrical fashion and are arranged in grooves associated with the holder.

4. The axial piston pump as in claim 3, wherein the piston drum and holder are designed for mutual and matching alignment with respect to the drive shaft during mounting.

5. The axial piston pump as in claim 4, wherein ball head supported on the holder is slidably arranged on the drive shaft.

6. The axial piston pump as in claim 5, wherein the ball head is prestressed by a compression spring, said compression spring positioned on the holder and supported by the piston drum, and acts on the ball head by way of pressure rods.

7. The axial piston pump according to claim 6, wherein a fitting spring arrangement is provided between the drive shaft and piston drum, and between the drive shaft and ball head, wherein the fitting spring arrangement includes a fitting spring that lies in a fitting spring groove, the fitting spring groove being arranged in the direction of the drive shaft axis.

8. The axial piston pump as in claim 1, wherein several glide blocks are distributed about the circumference of the spherical adjustment surface of the ball head in symmetrical fashion and are arranged in grooves associated with the holder.

9. The axial piston pump as in claim 1, wherein the piston drum and holder are designed for mutual and matching alignment with respect to the drive shaft during mounting.

10. The axial piston pump as in claim 1, wherein ball head supported on the holder is slidably arranged on the drive shaft.

11. The axial piston pump according to claim 1, wherein a fitting spring arrangement is provided between the drive shaft and piston drum, and between the drive shaft and ball head, wherein the fitting spring arrangement includes a fitting spring that lies in a fitting spring groove, the fitting spring groove being arranged in the direction of the drive shaft axis.

* * * * *